US007501031B2

(12) United States Patent
Takeuchi et al.

(10) Patent No.: US 7,501,031 B2
(45) Date of Patent: Mar. 10, 2009

(54) STEEL SHEET FOR TIN PLATED STEEL SHEET AND TIN-FREE STEEL SHEET EACH HAVING EXCELLENT FORMABILITY AND MANUFACTURING METHOD THEREOF

(75) Inventors: Satoshi Takeuchi, Tokai (JP); Riki Okamoto, Tokai (JP); Kazuhito Ito, Tokai (JP)

(73) Assignee: Nippon Steel Corporation, Tokyo (JP)

( * ) Notice: Subject to any disclaimer, the term of this patent is extended or adjusted under 35 U.S.C. 154(b) by 194 days.

(21) Appl. No.: 11/155,370

(22) Filed: Jun. 17, 2005

(65) Prior Publication Data

US 2005/0279432 A1 Dec. 22, 2005

(30) Foreign Application Priority Data

Jun. 18, 2004 (JP) ..... 2004-181234
Jun. 14, 2005 (JP) ..... 2005-174159

(51) Int. Cl.
*C22C 38/06* (2006.01)
*C22C 38/02* (2006.01)
*C22C 38/04* (2006.01)

(52) U.S. Cl. ..... 148/320; 420/8; 420/128

(58) Field of Classification Search ..... 148/320, 148/603; 420/128, 8
See application file for complete search history.

(56) References Cited

U.S. PATENT DOCUMENTS 4,586,965 A * 5/1986 Obara et al. ..... 148/651
5,587,027 A * 12/1996 Tosaka et al. ..... 148/320
5,725,697 A * 3/1998 Fujinaga et al. ..... 148/603
6,063,214 A * 5/2000 Fujinaga et al. ..... 148/602
2002/0096232 A1 7/2002 Nakai et al.
2002/0148536 A1 10/2002 Nakajima et al.
2003/0168134 A1 9/2003 Fujibayashi et al.

FOREIGN PATENT DOCUMENTS

| | | |
|---|---|---|
| EP | 0164263 | * 12/1985 |
| EP | 1 247 871 | 10/2002 |
| EP | 1 291 448 | 3/2003 |
| JP | 58048633 | 3/1983 |
| JP | A-61-69928 | 4/1986 |
| JP | 63134645 | 6/1988 |
| JP | A-01-184252 | 7/1989 |

(Continued)

OTHER PUBLICATIONS

Sachs, "Residuals in Engineering Steels", Metals Tech., Jan. 1979, pp. 33-37.

*Primary Examiner*—Deborah Yee
(74) *Attorney, Agent, or Firm*—Kenyon & Kenyon LLP

(57) ABSTRACT

The invention provides a steel sheet for hard tinplate and a TFS steel sheet each having an excellent formability and a temper grade of T4 to DR9, and an efficient manufacturing method capable of selectively manufacturing these steel sheets by using raw materials having the same composition, wherein, the steel sheet for hard tinplate and a TFS steel sheet having a temper grade of T4 to DR9 is manufactured from raw materials having the same composition by changing a reduction ratio of temper rolling or double reduce rolling for ultra-low carbon aluminum killed steel C and P contents of which are so regulated as to satisfy a specific formula <1>:

$$1.6\times C\times 10^4+0.93\times P\times 10^3 \geqq 70 \ldots \quad <1>.$$

2 Claims, 2 Drawing Sheets

FOREIGN PATENT DOCUMENTS

| | | |
|---|---|---|
| JP | A-09-157757 | 6/1997 |
| JP | A-2001-303181 | 10/2001 |
| JP | A-2002-60900 | 2/2002 |
| JP | 2002206138 | 7/2002 |
| WO | WO 03/031670 | 4/2003 |
| WO | WO 2004/003247 | 1/2004 |

* cited by examiner

STEEL SHEET FOR TIN PLATED STEEL SHEET AND TIN-FREE STEEL SHEET EACH HAVING EXCELLENT FORMABILITY AND MANUFACTURING METHOD THEREOF

TECHNICAL FIELD

This invention relates to a steel sheet for a tinplate (tin plated steel sheet) and a TFS (tin-free steel) steel sheet each having an excellent formability and a method for manufacturing them.

BACKGROUND ART

A steel sheet. for tinplate and a TFS steel sheet is generally manufactured selectively in accordance with a Rockwell hardness by once conducting temper rolling depending on a temper grade of tinplate to produce products having hardness of T1 to T5 (target Rockwell hardness (HR30T) of 49±3 to 65±3) and then conducting double reduce rolling to produce products having a temper grade of DR6 to DR10 (target Rockwell hardness (HR30T) of 78±3 to 80±3). To manufacture hard tinplate, therefore, a C content is increased so as to achieve a predetermined hardness range of the temper grade. Even when the hardness remains within the predetermined range, however, products fail, in some cases, to provide formability when the formability is required simultaneously with the hardness. When ultra-low C content is adopted to satisfy the formability, the formability can be satisfied but the hardness undesirably drops below a predetermined value.

To improve formability, a method for manufacturing a steel sheet excellent in both formability and corrosion resistance by reducing the C content to a ultra-low level, adding solid solution hardening elements such as Nb and B, and optimizing a soaking time and a cooling time of an annealing condition is described in Japanese Unexamined Patent Publication (Kokai) No. 9-157757, and so forth.

However, because the ASTM standard stipulates the upper limit amount of the solid solution hardening elements for the steel sheet for tinplate, sufficient amounts of addition elements cannot be added and hardening of the steel sheets becomes insufficient. Furthermore, the addition of Nb, B, etc, raises the annealing re-crystallization temperature and results in deterioration of a passing property an causes drifting of sheet and shape defects during annealing.

It has therefore been desired to develop a manufacturing method of a steel sheet capable of securing formability without adding solid solution hardening elements, if possible, and acquiring hardness of a required level.

Steel sheets such as tinplate and tin-free steel (TFS) sheets have gained a wide application as materials for plate working to produce cans. Production methods of two-piece cans as one of the forms of the cans include the following two systems. The first is a DI (Drawing and Ironing) system that once punches out the material into a metal cap shape, thinly draws a wall surface of a can and applies so-called "ironing". Printing is thereafter applied to the outer surface of the can. The material for this DI can has a relatively large thickness of 0.24 to 0.3 mm because ironing is applied.

The other system is DRD (Drawing and Re-drawing). The material is once punched out into a metal cap shape and is again punched out and shaped. Printing is thereafter applied to the outer surface of the can. Because ironing of the DI cans is not necessary, the material for the DRD cans is as thin as 0.2 mm or below. Because the material for the DRD cans is thin and must satisfy the predetermined compression strength, a high strength is required for the material. To secure the formability of the cans, the material must also have a small anisotropy.

Japanese Unexamined Patent Publication (Kokai) No. 61-69928 describes a manufacturing method of a steel sheet for DI processing having a temper grade of T2 to T4 which method reduces a C content to a ultra-low level and an O content to a low level to improve the formability, and stipulates a hot rolling condition, a cold rolling condition and a continuous annealing condition. However, the method of this patent document deals with steel sheets having a thickness of more than 0.2 mm but is not directed to steel sheets having a thickness of 0.2 mm or below.

Nonetheless, materials having low anisotropy are required in many cases for these can materials in order to prevent variance of deformation that occurs during processing after punch-out and printing to the surface, and to suppress the occurrence of a non-uniform ear or a so-called "earing" at the mouth edge of the can that occurs during deep drawing and causes a problem in cap processing.

Distortion printing materials, to which deep drawing is applied after printing is done on a steel sheet, are known in Europe, for example. In this case, punching and printing of the steel sheets are carried out while anisotropy of the steel sheets is taken into consideration.

When the earing is great, variance of anisotropy itself becomes great, too, and deviation of printing occurs. Therefore, users require a Δr value of≦approx. 0.2.

Cap processing includes trimming to align the ear portion but an attempt has been made to omit this trimming step. To eliminate the trimming step, the earing must be made small and users have required a further decrease the Δr value representing anisotropy to Δr value ≦ approx. 0.1. This Δr value will be described later.

Incidentally, an r value is known as one of the indices for evaluating the deformation characteristics of materials in deep drawing. This r value is called a "plastic strain ratio" and is defined by the following formula $$r = \ln(W_o/W)/\ln(T_o/T)$$
$$= \ln(W_o/W)/\ln(LW/L_oW_o)$$

when Lo, Wo and To as a first gauge length of a tensile test piece, a width of a parallel portion and a thickness, respectively, change to L, W, T after tensile deformation within a range in which necking does not occur, with the proviso that $L_oW_oT_o$=LWT.

This r value varies depending in which direction of a material sheet surface the tensile axis is taken, and is called "in-plane anisotropy".

This in-plane anisotropy is generally evaluated in terms of a Δr value of the following formula by examining the deformation characteristics in each direction by changing θ that is an angle between the tensile direction of the tensile test piece and the rolling direction of the material:

$$\Delta r=(r_o-2r_{45}+r_{90})/2$$

where $r_o$, $r_{45}$ and $r_{90}$ are r values at angles corresponding to 0°, 45° and 90° of the tensile direction with respect to the material rolling direction, respectively.

It is believed that the earing described above is closely related with in-plane anisotropy, and the smaller the Δr value, the smaller becomes in-plane anisotropy.

Japanese Unexamined Patent Publication (Kokai) No. 2002-60900 describes a steel sheet for deep drawn cans having excellent earing resistance that is manufactured by setting a sheet thickness of an Al killed steel containing B added thereto to 0.15 to 0.60 mm, a Δr value to a range of +0.15 to −0.08 and a heating rate at the time of re-crystallization annealing to 5° C./sec.

Japanese Unexamined. Patent Publication (Kokai) No. 2001-303181 describes a manufacturing method of can steel sheets having less skin coarsening after processing and small anisotropy using the steps of conducting lubrication rolling to a finish sheet thickness of 1.5 mm or below, conducting hot rolling and coiling the sheet, then applying pickling, cold rolling and annealing, and further conducting secondary rolling to manufacture can steel sheets, wherein manufacturing conditions are determined so that a value of a relational formula determined by a C content of the steel sheet, a coiling temperature (CT), a cold rolling reduction ratio (CR), a secondary rolling reduction ratio (DR), a hot rolled sheet thickness (t) and a maximum frictional coefficient (μ) falls within a predetermined range.

Japanese Unexamined Patent Publication (Kokai) No. 01-184252 disclosed a steel sheet for DI cans containing. C:0.0040 to 0.0600% and having excellent stretch-flange formability.

However, this steel sheet is for DI cans and has a thickness of more than 0.2 mm, and therefore characteristic of the steel sheet is different from the steel sheet of the present invention having a thickness of 0.2 mm or below.

Possibility of manufacturing of the steel sheet of T4 to DR9 from the component within the same range is not disclosed.

SUMMARY OF THE INVENTION

When hard tinplate having a temper grade of T4 to DR9 is manufactured as described above, it has been customary to manufacture the tinplate by using raw materials whose C and Mn contents are changed in accordance with the temper grade. However, when a plurality of raw materials containing necessary amounts of C and Mn are prepared in accordance with the temper grade to manufacture the hard tinplate, substitute steel materials must be prepared if the production of a steel sheet having a certain temper grade is cancelled for some reason or other and this is by no means easy in consideration of the time limit of delivery.

As described above, it is known to control the Δr value by the cold rolling reduction ratio and the temper rolling reduction ratio or the double reduce rolling reduction ratio. However, in Examples of Japanese Unexamined Patent Publication (Kokai) No. 2001-303181 described above, the Δr value greatly changes from 0.07 to −0.24 at a double reduce rolling reduction ratio of 0.5 to 19.5%.

It is therefore difficult to lower the in-plane anisotropy (Δr value) at the reduction ratio of temper rolling or double reduce rolling set to obtain a predetermined hardness level (HR30T), and it is also difficult to manufacture by this technology the steel sheets having small in-plane anisotropy and a temper grade of T4 to DR9 from steel materials having the same component series.

It is an object of the invention to provide a steel sheet for a hard tinplate and a TFS steel sheet each excellent in formability and having a sheet thickness of 0.2 mm or below, a temper grade of T4 to DR9 and preferably a small Δr value, and a manufacturing method for selectively manufacturing these steel sheets from steel materials of the same component range.

Here, the term "temper grade" has been used in the past as the term representing the grade of tinplate or TFS steel sheet after hardness adjustment.

In this invention, this term is used as the term representing the grade of the tinplate or TFS steel sheet inclusive of temper rolled steel sheets and double reduce rolled steel sheets. Table 1 tabulates the temper grade and the range of hardness (HR30T) at each grade.

TABLE 1

| temper grade | hardness range (HR30T) | reduction ratio of temper rolling or double reduce rolling |
|---|---|---|
| T4 | 61 ± 3 | 2.5 |
| T5 | 65 ± 3 | 6 |
| DR6 | 67 ± 3 | 8 |
| DR7 | 70 ± 3 | 15 |
| DR8 | 73 ± 3 | 25 |
| DR9 | 76 ± 3 | 35 |

The steel sheet for tinplate and TFS steel sheets having excellent formability and their manufacturing method according to the invention for achieving the object described above are as follows.

(1) A steel sheet for tinplate and a TFS steel sheet each having an excellent formability, containing in terms of percent by mass C:0.0030 to 0.0060%, Si:0.04% or below, Mn:0.60% or below, P:0.005 to 0.03%, S:0.02% or below, Al: more than 0.005% to 0.1%, N:0.005% or below, satisfying the following formula <1>, and the balance of Fe and unavoidable impurities, and having a sheet thickness of 0.2 mm or below and a hardness level (HR30T) of 61±3 to 76±3:

$$1.6\times+C\times10^4+0.93\times P\times10^3\geqq70 \quad <1>$$

(2) A steel sheet for tinplate and a TFS steel sheet each having an excellent formability as described in (1), wherein a Δr value representing in-plane anisotropy of the steel sheet is not greater than ±0.2.

(3) A steel sheet for tinplate and a TFS steel sheet each having an excellent formability as described in (1), wherein a Δr value representing in-plane anisotropy of the steel sheet is not greater than ±0.1.

(4) A method for manufacturing a steel sheet for tinplate and a TFS steel sheet each having excellent formability, comprising the steps of hot rolling a steel containing in terms of percent by mass C:0.0030 to 0.0060%, Si:0.04% or below, Mn:0.60% or below, P:0.005 to 0.03%, S:0.02% or below, Al: more than 0.005% to 0.1%, N:0.005% or below, satisfying the following formula <1>, and the balance of Fe and unavoidable impurities, at a finish rolling temperature of an $Ar_3$ temperature or above and a coiling temperature within the range of 650° C.±50° C.; conducting cold rolling at a reduction ratio of 85 to 95%; conducting then annealing at a re-crystallization temperature or above; further conducting temper rolling or double reduce rolling to selectively manufacture steel sheets having different hardness, a sheet thickness of 0.2 mm or below, and a hardness level (HR30T) of 61±3 to 76±3:

$$1.6\times C\times10^4+0.93\times P\times10^3\geqq70 \quad <1>$$

(5) A method for manufacturing a steel sheet for tinplate and a TFS steel sheet each having excellent formability as described in (4), wherein a temper rolling reduction ratio or a double reduce rolling reduction ratio in the temper rolling or the double reduce rolling satisfies the following formula <2>:

$$\text{target hardness level } (HR30T) = 5.33011nR_2 + 55.76 \quad <2>$$

where $R_2$: temper rolling reduction ratio or double reduce rolling reduction ratio.

(6) A method for manufacturing a steel sheet for tinplate and a TFS steel sheet each having excellent formability as described in (4) or (5), wherein the cold rolling reduction ratio is 88 to 93%.

(7) A method for manufacturing a steel sheet for tinplate and a TFS steel sheet each having excellent formability as described in (4) or (5), wherein the cold rolling reduction ratio is 89.6 to 91.6%.

In other words, the invention is completed on the basis of an extremely novel finding that when a ultra-low C steel sheet is used to improved formability, [C] is increased within the range in which formability is maintained and the P concentration is adjusted so as to satisfy the formula <1> described above, the increment ratio of the hardness (strength) can be increased owing to the increase of the temper rolling reduction ratio or the double reduce rolling reduction ratio and a steel sheet for tinplate and a TFS steel sheet each having excellent formability, small in-plane anisotropy and a temper grade of T4 to DR9 can be selectively manufactured from steel sheets having the same component range.

Incidentally, temper rolling or double reduce rolling is rolling that is carried out after a continuous annealing step that continues an ordinary cold rolling step to adjust materials.

The invention specifies the reduction ratio of temper rolling to about 0.5 to about 5% and the reduction ratio of double reduce rolling to about 5 to about 35%.

Further, the term "steel sheets having a temper grade of T4 to DR9" in the invention represents those steel sheets whose target hardness level has T4 (61±3), T5 (65±3), T6 (70±3), DR7 (70±3), DR8 (73±3) and DR9 (76±3).

According to the manufacturing method of the invention for manufacturing steel sheets for tinplate having excellent formability, steel sheets having a temper grade of T4 to DR9 can be manufactured from the same component series. Therefore, it is not necessary to prepare raw materials having a plurality of compositions, but is possible to efficiently manufacture the steel sheets. Therefore, the effect of the invention is extremely great.

THE MOST PREFERRED EMBODIMENT

When a hard tinplate having a temper grade between T4 and DR9 is manufactured, the invention of this application stipulates C to a range of 0.0030 to 0.0060%, sets both C and P of a steel sheet in such a fashion as to satisfy the relation of a formula <1>, conducts temper rolling or double reduce rolling at a rolling reduction ratio in accordance with the temper grade, and manufactures a hard tinplate having a temper grade of T4 to DR9even by using the same raw material composition at a sheet thickness of 0.2 mm or below.

Figure 1:
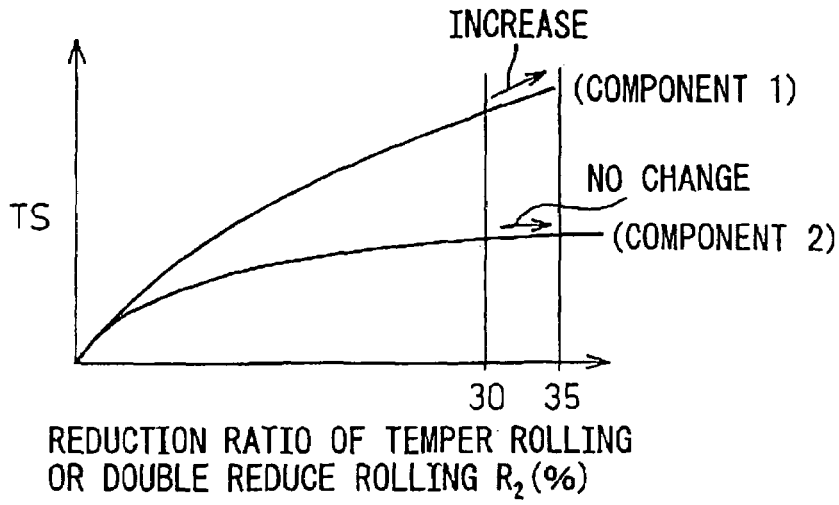
FIG. 1 is an explanatory view showing the relation of the reduction ratio of temper rolling or double reduce rolling and TS (strength, hardness) in cases of component 1 and component 2 where C concentration is different each other.
Figure 2:
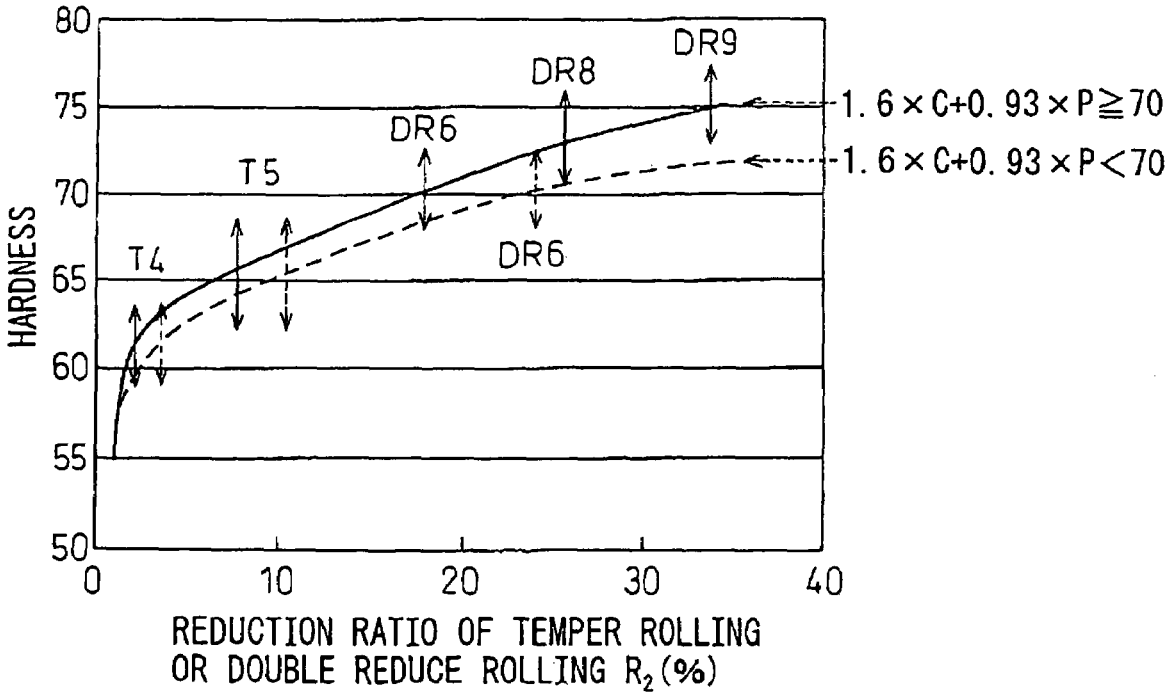
FIG. 2 is an explanatory view showing the relation a reduction ratio of temper rolling or double reduce rolling and a hardness in cases where formulas <1> of the invention is satisfied or not.

The background why the invention is proposed is as follows. When components are selected within a range that maintains a formability, (component 1), as shown in FIG. 1, an increment ratio of hardness (strength) becomes high with an increase of the reduction ratio of temper rolling or double reduce rolling. Unless the components are selected within the range described above, (component 2), on the other hand, the hardness (strength) gets into saturation even when the reduction ratio of temper rolling or double reduce rolling is increased and predetermined hardness (strength) cannot be obtained even when the reduction ratio of temper rolling or double reduce rolling is increased.

The present inventors have found that when C and P concentrations are adjusted, target hardness (strength) can be obtained by the increase of the reduction ratio of temper rolling or double reduce rolling as shown in FIG. 1 even when Nb, B, etc, are not added as done in the prior art example.

In other words, the present inventors have conducted various experiments and have found the relation of the formula <1> with hardness and the rolling reduction ratio in temper rolling or double reduce rolling, that is, $1.6\times C\times 10^4+0.93\times P\times 10^3 \geqq 70$ stipulated in the invention.

As a result, when the components satisfy the relation of the formula <1>, that is, $1.6\times C\times 10^4+0.93\times P\times 10^3 \geqq 70$ stipulated in the invention, steel sheets having a temper grade of T4 to DR9 can be selectively manufactured by selecting the rolling reduction ratio of temper rolling or double reduce rolling (temper rolling reduction ratio or double reduce rolling reduction ratio) in accordance with the temper grade as tabulated in Table 1.

On the other hand, when $1.6C+0.932<70$, the increment ratio of the hardness is small and hard tinplate of DR8 or DR9 cannot be manufactured even when the reduction ratio of temper rolling or double reduce rolling is changed in steels having the same component range. It is thus obvious that steel sheets having a temper grade of T4 to DR9 cannot be manufactured from components within the same range.

Next, the reasons for limitation of the components in the present invention is described as follows.

C is one of the important elements in the invention. As a result of intensive studies, the inventors have found that solid solution C and the grain diameter interact with each other during temper rolling or double reduce rolling, though the reason has not yet been clarified, and the hardness can be greatly changed. To secure the hardness of the target temper grade of DR8 by effectively utilizing this effect, 30 ppm is necessary as the lower limit of the C amount. On the other hand, the addition of a large C amount deteriorates the formability of the material. Therefore, the range of the C amount is 30 to 60 ppm.

Si is the substitution type solid solution hardening element that not only deteriorates the corrosion resistance of the tinplate but greatly hardens the material, and is not preferable for improving ductility and formability. Therefore, the upper limit is set to 0.04%.

When exceeding 0.6%, Mn sometimes deteriorates the formability. Therefore, the upper limit is set to 0.6%.

P is one of the important elements of the invention. Though P generally improves the strength of the steel sheet, it is generally preferred to reduce the P amount because P deteriorates formability and corrosion resistance. Therefore, the upper limit is set to 0.03%. When added, on the other hand, P makes the crystal grains fine, increases the grain boundary for the interaction with solid solution C and facilitates selectively hardness by temper rolling and double reduce rolling. To enjoy these effects, the addition of at least 0.005% of P is necessary.

S is the element the existence of which in the steel is not preferred. Particularly to improve the formability, the S amount is preferably small. Therefore, the upper limit is set to 0.02%.

Al is added as a deoxidizing agent to improve cleanliness of the steel. To improve cleanliness, more than 0.005% of Al must be added. However, the addition of Al in an amount more than 0.1% makes AlN coarse and results in the occurrence of cracks during plate working. Therefore, the upper limit is set to 0.1%.

N sometimes strengthens the materials by age hardening. Because the solid solution N amount greatly changes depending on a coiling temperature, however, N is not suitable for obtaining a stable material. When large amounts of N are added, AlN is formed and invites the occurrence of cracks during plate working. Therefore, the upper limit is set to 0.005%.

Next, the condition of temper rolling or double reduce rolling as one of the important constituent requirements of the invention will be described.

The present inventor has found that when the C content is increased within a range where the formability is maintained in a steel sheet for hard tinplate, the increment ratio of the hardness due to the increase of the reduction ratio in temper rolling or double reduce rolling and steel sheets having temper grades of T4 to DR9 can be selectively manufactured from the steel sheets having the same component range. In other words, the invention makes it possible to manufacture a steel sheet for hard tinplate of T4 to DR9 from materials having the same composition ratio by adjusting the reduction ratios in temper rolling or double reduce rolling with the exception of steel sheets for soft tinplate having temper grades of T1, T2 and T3 and a steel sheet for hard tinplate having a temper grade of DR10.

The inventors of the invention have conducted intensive studies to selectively manufacture steel sheets having different hardness of T4 to DR9 by temper rolling or double reduce rolling and have found that steel sheets having different hardness can be selectively manufactured dependent on the temper rolling reduction ratio or double reduce rolling reduction ratio by utilizing the interaction between the solid solution C amount and the grain boundary and adjusting this interaction. The inventors have found also that to effectively enjoy this effect, it is important to adjust the addition amounts of C and P and have clarified the relation of the formula <1>. On the other hand, the addition of excessive amounts of C and P provides the excessive effect owing to the interaction, the hardness change becomes large amount with respect to the rolling reduction ratio and stable manufacture becomes difficult to carry out. In the T4 and T5 class where the formability is required, in particular, it is more preferred to satisfy the relation of the formula <3> as the upper limit in view of deterioration of the formability.

$$70 \leqq 1.6 \times C \times 10^4 + 0.93 \times P \times 10^3 \leqq 85 \quad <3>$$

The inventors have furthered their studies and have examined application of dislocation and exothermy of working. The inventors have thus found that because both dislocation amount and exothermic amount increase with the increase of the reduction ratio in temper rolling or double reduce rolling, the interaction between solid solution C and the grain boundary operates more effectively and the increase of the hardness greatly depends on the rolling reduction ratio. The inventors have clarified the relational formula between the temper rolling reduction ratio or the double reduce rolling reduction ratio stably providing the effect and the hardness when the components of the steel sheet satisfy the relation of the formula <1>. In other words, the inventors have found that the target hardness can be achieved by controlling the rolling condition for the temper rolling reduction ratio or the double reduce rolling reduction ratio derived from the formula <2>.

$$\text{target hardness level } (HR30T) = 5.33011 n(R_2) + 55.76 \quad <2>$$

where $R_2$ is the temper rolling reduction ratio or double reduce rolling reduction ratio (%).

The temper rolling reduction ratio or the double reduce rolling reduction ratio as the essential requirement of the invention have already been described. Therefore, other manufacturing conditions will be described.

As for the finish temperature of hot rolling, hot rolling must be carried out at 850° C. or above to prevent the drop of the formability because strain is excessively applied to the ferrite grains. The re-crystallization grain size becomes coarse beyond the necessary level after annealing when the temperature is excessively high. Therefore, the temperature is preferably 960° C. or below. To suppress the formation of AlN, the mean cooling rate from the hot rolling finish temperature to the coiling temperature must be at least 15° C./s. To suppress the formation of AlN, the mean cooling rate till 700° C. is preferably at least 50° C./s. As for the coiling temperature, a higher finish temperature promotes recrystallization and grain growth and improves the formability. However, because the higher finish temperature promotes also precipitation of AlN, the temperature must be 570° C. or higher.

Cold rolling after pickling is carried out at a reduction ratio of at least 50% because correction of the shape of the steel sheet becomes difficult when the reduction ratio is low. When the steel sheet is rolled at a reduction ratio higher than 98%, deterioration of local ductility undesirably occurs in some cases. To further improve the formability, a high r value is preferred. Therefore, the reduction ratio is preferably within the range of 70 to 95%. When the continuous annealing temperature is too low, the texture enters the non re-crystallization state and is hardened and when it is too high, on the contrary, the grains become coarse. Therefore, the continuous annealing temperature is from 600° C. to the austenite temperature zone.

The inventors have also examined in-plane anisotropy in the steel sheet for the hard tinplate or TFS steel sheets described above.

In other words, as to the steel sheets of the invention satisfying the composition and the formula <1> described above and the steel sheets not satisfying the composition or the formula <1> described above, hard tinplate or TFS steel sheets are manufactured while the hot rolling condition, the cold rolling condition, the annealing condition and other conditions are kept the same, and the relation between a Δr value of each steel sheet and the reduction ratio of temper rolling or double reduce rolling is examined. Also, the reduction ratio of cold rolling is changed, and its influences are confirmed.

Figure 3:
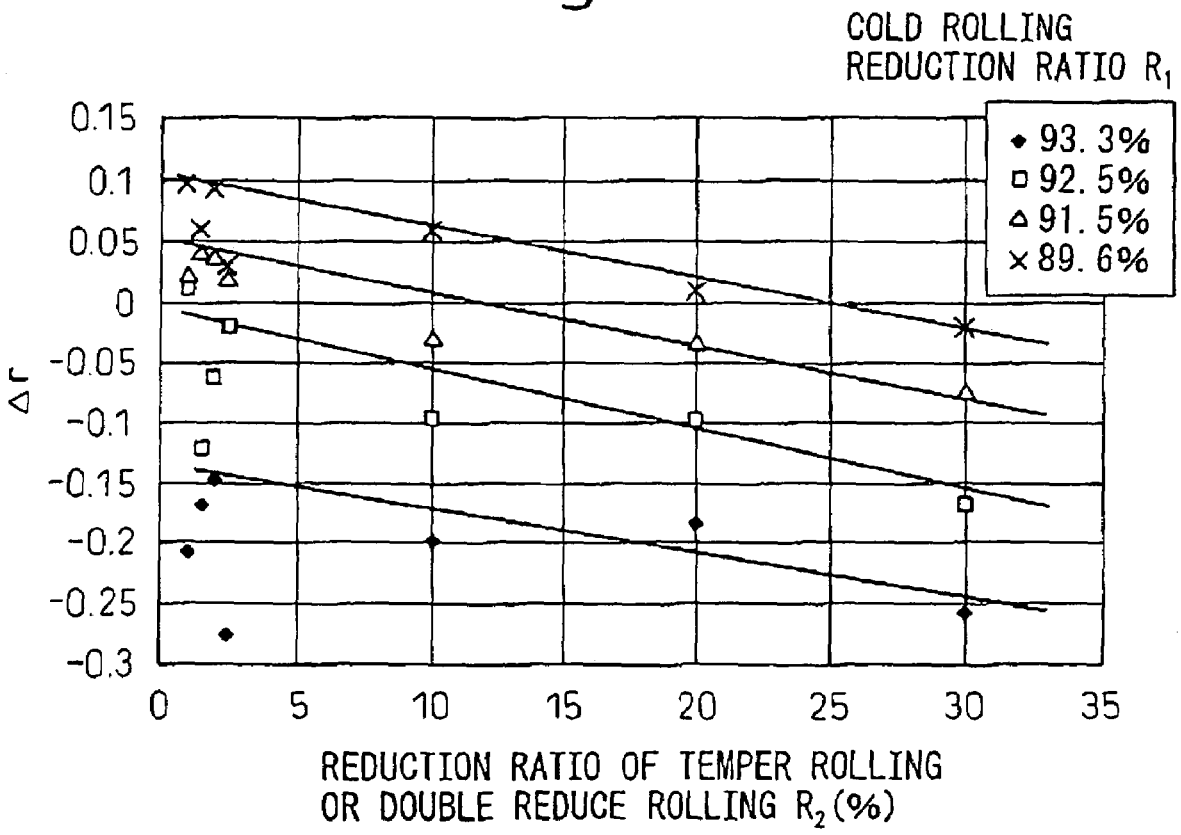
FIG. 3 is a graph showing the relation of Δr in a steel of the invention, a reduction ratio of cold rolling and a reduction ratio of temper rolling or double reduce rolling.

FIG. 3 shows the result. FIG. 3 shows the relation of the Δr value and the reduction ratio of cold rolling ($R_1$ (%)) and the reduction ratio of temper rolling or double reduce rolling ($R_2$ (%)). As shown in FIG. 3, the Δr value decreases with the increase of the reduction ratio of temper rolling or double reduce rolling and its gradient is smaller in the steel sheets satisfying the composition of the invention and the formula <1> than the steel sheets not satisfying the composition of the invention and the formula <1>.

It can also be understood that the Δr value indicating anisotropy is generally small.

This means that the influences of the reduction ratio of temper rolling or double reduce rolling with respect to the Δr value are small in the steel sheets satisfying the composition of the invention and the formula <1> and that even when the reduction ratio of temper rolling or double reduce rolling is changed to obtain a required temper grade, anisotropy does not much change and steel sheets having small anisotropy can be obtained stably.

The Δr value greatly changes depending on the reduction ratio of cold rolling as can be seen from FIG. 3, and this influence is greater than the influence on the Δr value by the reduction ratio of temper rolling or double reduce rolling. In other words, steel sheets having small anisotropy can be obtained by adjusting the reduction ratio of cold rolling.

When Δr value≦±0.2, for example, the reduction ratio of cold rolling is 88 to 93%, preferably 88.0 to 92.7%. When Δr value≦±0.1, the reduction ratio of cold rolling is preferably 89.6 to 91.1%.

In other words, the following formula <4> can be acquired from the relation of the Δr value, the reduction ratio ($R_1$ (%)) of cold rolling and the reduction ratio ($R_2$ (%)) of temper rolling or double reduce rolling shown in FIG. 3:

$$\Delta r = 5.77 - 6.32 \times (R_1/100) - 0.3 \times (R_2/100) \quad <9>$$

When the reduction ratio ($R_1$) of cold rolling is calculated when the Δr value becomes 0.2 at the reduction ratio of double reduce rolling ($R_2$) of 2.5% on the basis of this formula, 88% is the minimum value of the reduction ratio of cold rolling ($R_1$).

Similarly, when the reduction ratio ($R_1$) of cold rolling is calculated when the Δr value becomes −0.2 at the reduction ratio of double reduce rolling ($R_2$) of 35%, 92.7% is obtained. When variance of the reduction ratio and the measurement error are taken into consideration, 93% is the minimum value of the reduction ratio ($R_1$) of cold rolling.

It can be understood that in order to set Δr to the range of ±0.2 at a reduction ratio ($R_2$) of 2.5 to 35% of double reduce rolling for acquiring the hardness level (HR30T) of T4 to FR9 in the invention, the reduction ratio ($R_1$) of cold rolling is preferably set to 88 to 93% variance of reduction ratio and measurement error are taken into consideration.

To further decrease anisotropy such as when the Δr value is set to the range of ±0.1, the reduction ratio ($R_1$) of cold rolling at which the Δr value is 0.1 when the reduction ratio ($R_2$) of double reduce rolling is 2.5% is 89.6% and the reduction ratio ($R_1$) of cold rolling when the Δr value is −0.1 is 91.6%. The minimum value of the reduction ratio ($R_1$) of cold rolling-is preferably 89.6 to 91.6%.

As described above, in the steel sheets having the composition of the invention and falling within the composition range that satisfies the formula <1>, the increment ratio of the hardness owing to the increase of the reduction ratio of temper rolling or double reduce rolling is great. Therefore, a broad range of steel sheets having different temper grades can be selectively manufactured from the steel raw materials falling within the same composition range. Further, steel sheets having small anisotropy can be stably manufactured when the reduction ratio in cold rolling is adjusted because the change of the Δr value owing to the increase of the reduction ratio of temper rolling or double reduce rolling is small.

In other words, steel sheets of T4 to DR9 having different temper grades can be manufactured from the steel raw materials falling within the same composition range by adjusting the reduction ratio in cold rolling and the reduction ratio of temper rolling or double reduce rolling.

Incidentally, FIG. 3 explains the components falling within the component range of the invention and within the formula <1> but does not explain those components which do not fall within the component range of the invention and within the formula. <1>.

As for the steel sheets that do not satisfy the components of the invention, Δr of the steel sheets that satisfy the formula <1> but have the components exceeding the upper limit of the component range of the invention becomes small with the increase of the reduction ratio and falls below −0.2 (see Comparative Example 15 in Table 3) as will be described later.

In other words, in those steel sheets which satisfy the formula <1> but contain the components exceeding the upper limit of the component range of the invention, the tilt of Δr with respect to the temper rolling reduction ratio or the double reduce rolling reduction ratio becomes great.

In the case of those steel sheets that are less than the lower limit of the component range of the invention and do not satisfy the formula <1> as represented by Comparative Example 13 or 14 in Table 3, it is not possible to selectively manufacture steel sheets of T4 to DR9 by the components within the same range because the hardness corresponding to the temper rolling reduction ratio or double reduce rolling reduction ratio cannot be obtained though Δr satisfies the range of −0.2 to 0.2.

Furthermore, in the case of those steel sheets having components which fall within the component range of the invention but do not satisfy the formula <1>, it is assumed that steel sheets of T4 to DR9 cannot be manufactured selectively by the components within the same range because the hardness corresponding to the temper rolling reduction ratio or the double reduce rolling reduction ratio cannot be obtained though Δr satisfies the range of −0.2 to 0.2.

EXAMPLES

Ultra-low carbon aluminum killed steels each having a composition tabulated in Table 2 were continuously cast and each of the resulting slabs was hot rolled at a temperature above a finish temperature $Ar_3$ (890° C. or above) and a coiling temperature of 650 to 750° C. to give a hot rolled coil having a sheet thickness of 2.2 to 2.5 mm and a sheet width of 900 to 1,200 mm. Each hot rolled coil was pickled and subjected to cold rolling at a reduction ratio tabulated in Table 2 to give a cold rolled coil having a sheet thickness of 0.15 to 0.20 mm. Each coil was thereafter annealed continuously at an annealing temperature of 690 to 800° C. and was temper rolled at a rolling reduction ratio tabulated in Table 2.

Hardness (HR30T) and the Δr value were measured for each steel sheet. The material test values were also tabulated in Tables 2 and 3 (Table 2 continued).

Incidentally, the steels according to Examples did not contain components lowering the re-crystallization temperature such as Nb. Therefore, the annealing temperature could be lowered in continuous annealing and the operation remained stable.

TABLE 2

| No | sheet | temper grade | component (%) C | Si | Mn | P | S | Al | N | left side value of formula <1> | Cold, rolling reduction ratio $R_1$ (%) | reduction ratio $R_2$ of temper rolling or double reduce rolling (%) | hardness HR-30T | approval/ rejection (*) |
|---|---|---|---|---|---|---|---|---|---|---|---|---|---|---|
| 1 | example | T4 | 0.0036 | 0.006 | 0.230 | 0.015 | 0.006 | 0.031 | 0.0017 | 71.55 | 89.6 | 2.5 | 58.3 | ○ |
| 2 | example | T5 | 0.0036 | 0.006 | 0.230 | 0.015 | 0.006 | 0.031 | 0.0017 | 71.55 | 90.5 | 6 | 62.5 | ○ |
| 3 | example | DR6 | 0.0036 | 0.006 | 0.230 | 0.015 | 0.006 | 0.031 | 0.0017 | 71.55 | 90.5 | 8 | 65.1 | ○ |
| 4 | example | DR7 | 0.0036 | 0.006 | 0.230 | 0.015 | 0.006 | 0.031 | 0.0017 | 71.55 | 90.2 | 15 | 68.1 | ○ |
| 5 | example | DR8 | 0.0036 | 0.006 | 0.230 | 0.015 | 0.006 | 0.031 | 0.0017 | 71.55 | 90.1 | 25 | 70.5 | ○ |
| 6 | example | DR9 | 0.0036 | 0.006 | 0.230 | 0.015 | 0.006 | 0.031 | 0.0017 | 71.55 | 91.1 | 35 | 73.4 | ○ |
| 7 | example | T4 | 0.0047 | 0.013 | 0.250 | 0.010 | 0.010 | 0.046 | 0.0027 | 84.5 | 88 | 2.5 | 63.1 | ○ |
| 8 | example | T5 | 0.0047 | 0.013 | 0.250 | 0.010 | 0.010 | 0.046 | 0.0027 | 84.5 | 92.1 | 6 | 66.8 | ○ |
| 9 | example | DR6 | 0.0047 | 0.013 | 0.250 | 0.010 | 0.010 | 0.046 | 0.0027 | 84.5 | 91.8 | 8 | 69.1 | ○ |
| 10 | example | DR7 | 0.0047 | 0.013 | 0.250 | 0.010 | 0.010 | 0.046 | 0.0027 | 84.5 | 92.7 | 15 | 72.3 | ○ |
| 11 | example | DR8 | 0.0047 | 0.013 | 0.250 | 0.010 | 0.010 | 0.046 | 0.0027 | 84.5 | 92.7 | 25 | 74.9 | ○ |
| 12 | example | DR9 | 0.0047 | 0.013 | 0.250 | 0.010 | 0.010 | 0.046 | 0.0027 | 84.5 | 92.7 | 35 | 77.5 | ○ |
| 13 | comparative example | DR8 | 0.0022 | 0.007 | 0.260 | 0.017 | 0.007 | 0.033 | 0.0020 | 51.01 | 90.1 | 25 | 68.7 | X |
| 14 | comparative example | DR9 | 0.0010 | 0.022 | 0.2 | 0.014 | 0.011 | 0.04 | 0.0021 | 29.02 | 90.5 | 35 | 71.2 | X |
| 15 | comparative example | T4 | 0.008 | 0.015 | 0.22 | 0.025 | 0.013 | 0.05 | 0.0023 | 151.25 | 92.7 | 2.5 | 64.2 | X |

(*)
○: approval
X: rejection

TABLE 3

(Table 2 continued)

| No | sheet | reduction ratio $R_2$ of temper rolling or double reduce rolling (%) | cold rolling reduction ratio $R_1$ (%) | Δr |
|---|---|---|---|---|
| 1 | example | 2.5 | 89.6 | 0.08 |
| 2 | example | 6 | 90.5 | −0.03 |
| 3 | example | 8 | 90.5 | 0.03 |
| 4 | example | 15 | 90.2 | 0.04 |
| 5 | example | 25 | 90.1 | −0.01 |
| 6 | example | 35 | 91.1 | −0.08 |
| 7 | example | 2.5 | 88 | 0.19 |
| 8 | example | 6 | 92.1 | −0.13 |
| 9 | example | 8 | 91.8 | −0.10 |
| 10 | example | 15 | 92.7 | −0.11 |
| 11 | example | 25 | 92.7 | −0.15 |
| 12 | example | 35 | 92.7 | −0.18 |
| 13 | comparative example | 25 | 90.1 | −0.02 |
| 14 | comparative example | 35 | 90.5 | 0.05 |
| 15 | comparative example | 2.5 | 92.7 | −0.30 |

As can be seen from Tables 2 and 3, Comparative Examples 13 to 15 were outside the range of the invention and Comparative Examples 13 and 14 not satisfying the formula <1> could not obtain the desired hardness of temper grads of DR8 and DR9. Though satisfying the formula <1>, Comparative Example 15 had inferior formability because C was high for a temper grade of T4, and its anisotropy was high, too.

Comparative Example 13 cannot secure the hardness of DR8 even when the double reduce rolling reduction ratio is 25%. Therefore, the hardness of DR9 cannot be secured at the double reduce rolling reduction ratio of 35% and products of T4 to DR6 cannot be manufactured by these components.

Comparative Example 14 cannot secure the hardness of DR9 even when the double reduce rolling reduction ratio is 35%. Therefore, products of T4 to DR6 cannot be manufactured by these components.

In contrast, Examples 1 to 12 according to the invention, a required hardness level (HR30T) could be secured by selecting a necessary reduction ratio of temper rolling or double reduce rolling in accordance with the temper grade. The Δr value was small as a whole and variance owing to the reduction ratio of temper rolling was small. Further, in-plane anisotropy was small, too.

The invention claimed is:

1. A steel sheet for tinplate and/or a TFS steel sheet each having an excellent formability, the steel of said steel sheet consisting essentially of in terms of percent by mass:

C: 0.0030 to 0.0060%,

Si: 0.04% or below,

Mn: 0.60% or below,

P: 0.005 to 0.03%,

S: 0.02% or below,

Al: more than 0.005% to 0.1%,

N: 0.005% or below, satisfying the following formula <1>, and the balance of Fe and unavoidable impurities, wherein the steel of said steel sheet contains substantially no Nb, and the steel sheet having a sheet thickness of 0.2 mm or below and a hardness level (HR30T) of 61±3 to 76±3, and a Δr value representing in-plane anisotropy of said steel sheet in a range of −0.1 to +0.1;

$$1.6\times C\times 10^4+0.93\times P\times 10^3 \geqq 70 \ldots \quad <1>.$$

2. A steel sheet for tinplate and/or a TFS steel sheet each having an excellent formability, the steel of said steel sheet consisting essentially of in terms of percent by mass:

C: 0.0030 to 0.0060%,

Si: 0.04% or below,

Mn: 0.60% or below,

P: 0.005 to 0.03%,

S: 0.02% or below,

Al: more than 0.005% to 0.1%,

N: 0.005% or below, satisfying the following formula <1>, and the balance of Fe and unavoidable impurities, wherein the steel of said steel sheet contains substantially no Nb, and the steel sheet having a sheet thickness of 0.2 mm or below and a hardness level (HR30T) of 61±3 to 76±3, and a Δr value representing in-plane anisotropy of said steel sheet is in a range of −0.2 to +0.2;

$$1.6\times C\times 10^4+0.93\times P\times 10^3\geqq 70 \ldots \quad \text{<1>.}$$

* * * * *